US006105405A

United States Patent [19]

Westwinkel

[11] Patent Number: 6,105,405

[45] Date of Patent: Aug. 22, 2000

[54] LOCKING APPARATUS HAVING A UNITARY DRIVER

[75] Inventor: Florian Westwinkel, Toronto, Canada

[73] Assignee: Wesko Systems Limited, Mississauga, Canada

[21] Appl. No.: 09/199,796

[22] Filed: Nov. 25, 1998

[51] Int. Cl.[7] ..... E05B 9/04

[52] U.S. Cl. ..... 70/371; 70/379 R; 70/386

[58] Field of Search ..... 70/367–371, 379 R, 70/380, 386

[56] References Cited

U.S. PATENT DOCUMENTS

| | | | |
|---|---|---|---|
| 1,692,826 | 11/1928 | Ganz | 70/386 |
| 3,824,817 | 7/1974 | Orr | 70/371 X |
| 4,250,725 | 2/1981 | Prunbauer | 70/386 X |
| 4,381,656 | 5/1983 | Hayakawa | 70/370 X |
| 5,295,376 | 3/1994 | Myers | 70/386 X |
| 5,428,978 | 7/1995 | Tsukano | 70/386 |
| 5,435,159 | 7/1995 | Ramsauer | 70/370 |
| 5,606,882 | 3/1997 | Larsen et al. | 70/369 |
| 5,634,359 | 6/1997 | Huebschen | 70/367 X |
| 5,799,520 | 9/1998 | Laabs et al. | 70/360 |
| 5,884,510 | 3/1999 | Crocco et al. | 70/371 X |
| 5,907,963 | 6/1999 | Myers et al. | 70/379 R X |

FOREIGN PATENT DOCUMENTS

| | | | |
|---|---|---|---|
| 3905353 | 8/1990 | Germany | 70/386 |

OTHER PUBLICATIONS

Ciocean Product Drawings pp. 2.11 and 2.12.
Ciocean Component Parts Sheet pp. 1.107 and 1.108.

*Primary Examiner*—Suzanne Dino Barrett
*Attorney, Agent, or Firm*—Arent Fox Kintner Plotkin & Kahn PLLC

[57] ABSTRACT

A locking apparatus is provided that includes a unitary driver comprising a driving portion and a tenon portion. The driver is machined as a single part. A hollow housing is provided with an open end for receiving the driver. The tenon extends from the open end. The driving portion is rotatable in the housing between locked and unlocked positions. A channel is provided between opposing surfaces of the housing and the driver, within the interior of the housing. A retainer is received in transverse openings communicating with the channel. A number of retainer members may extend into the housing to engage the driving portion of the driver. A detent feature may be provided to identify discrete locked and unlocked positions. A locking latch is coupled to the tenon. A stop member is coupled to the housing. The stop member extends along the housing and engages the drawer to prevent removal of the housing from the drawer.

26 Claims, 5 Drawing Sheets

LOCKING APPARATUS HAVING A UNITARY DRIVER

FIELD OF THE INVENTION

The invention relates to locking mechanisms for office furniture, cabinets and other storage compartments.

BACKGROUND OF THE INVENTION

Locking mechanisms for office furniture items have become very popular in recent years due to the confidential or private nature of information kept in many offices. As a result, office furniture such as for example, filing cabinets, credenzas and desks are commonly built with key locks so that drawers may be locked to prevent unauthorized persons from accessing sensitive documents. These locking mechanisms have previously been built into a housing which is received into an opening formed in a drawer. Standard locking mechanisms include a driver which is rotated by a key to rotate a separate tenon. The tenon is coupled to a latch whereby the rotation of the tenon is translated to movement of the latch between locked and unlocked positions. These locking mechanisms are provided with a detent in order to provide discrete locked and unlocked positions. A spring and ball type detent mechanism is most commonly used. The spring is built into the driver portion of the locking mechanism. This arrangement requires the tenon and the driver portions of the locking mechanism to be inserted into opposite sides of the locking core housing. The driver and the tenon are then joined together mechanically. Most commonly, these portions are joined together by riveting, screws, nuts or other fasteners. This arrangement may also require the use of an O-ring to firmly secure the moving parts in rotational engagement with the locking core housing.

The prior art systems have the disadvantage of requiring separately machined tenon and driver components. This results in elevated manufacturing costs and assembly time. These systems are also prone to failure, in part, because the tenon and driver must be securely riveted or screwed together in proper alignment relative to each other and to the housing. For example, the repetitive snapping or jarring action of the detent over extended periods of operation may cause the screw to pop out resulting in separation of the tenon and driver, leading to mechanical failure of the part.

Prior art locking mechanisms also require the housing to be fastened to a retaining plate by means of a discrete, rearward mounted retainer clip. This arrangement requires an installer to climb behind the furniture item and to install the retainer clip. This is very inconvenient and leads to elevated costs due to increased labour time. Installation errors may also occur where the retainer clip is installed improperly.

There is therefore a need for a locking mechanism for storage containers including office furniture drawers wherein the driver and the tenon can be machined as a single piece. This unitary construction will avoid many of the problems associated with the prior art systems. Production costs are likely to decline and a locking system will result that are less prone to failure.

SUMMARY OF THE INVENTION

A locking apparatus is provided having a unitary driver. The driver includes a tenon that is integrally formed with a driving portion. The tenon is rotatable together with the driving portion. The driver is rotatably disposed in a housing and is rotatable between locked and unlocked positions. The locking apparatus includes a detent member that is coupled to the housing to engage the driving member when positioned in discrete locked and unlocked positions.

According to another aspect of the invention, a locking apparatus is provided with a unitary driver. The driver includes a tenon that is integrally formed with a driving portion and is rotatable therewith. The driver is rotatably disposed in a housing and is rotatable between locked and unlocked positions. The locking apparatus includes a detent member that is coupled to the housing to engage the driving member thereby permitting for discrete locked and unlocked positions. The detent member includes a retainer for securing the locking apparatus to a secure portion of the body of the furniture piece. For example, in one embodiment, the retainer may secure the detent by abutting against a retaining plate that is fastened to the furniture item.

According to one aspect of the invention, a locking apparatus is provided. The locking apparatus has an elongate housing having first and second open ends. The housing defines a longitudinal chamber between the ends. The housing further defines a transverse opening located between the first and second ends. The locking apparatus has a unitary driver, a portion of which is rotatably disposed within the chamber. The driver has a driving portion located in the chamber near the second end and a tenon portion extending from the second end of the housing. The driving portion is integrally formed to the tenon portion and rotatable therewith. The driver is rotatable between a locked position and an unlocked position. The locking apparatus has a detent member coupled to, or engaging with, the housing. The detent member is received in the transverse opening of the housing and extends into the chamber to engage the driving member and secure the driving member against longitudinal displacement from the housing. In some embodiments, the detent member may be adopted to provide a detent to signal to the operator that the driving member is in either the open or locked positions.

According to another aspect of the invention, a locking apparatus for installation into a movable drawer is provided with an elongate housing having first and second open ends. The housing defines a longitudinal chamber between the first and second ends. The housing further defines a transverse opening between the first and second ends. The locking mechanism has a unitary driver, a portion of which is rotatably disposed in the chamber. The driver has a driving portion adapted to be located in the chamber near the second end and a tenon portion to extend beyond the second end upon installation of the driving portion within the chamber. The tenon portion is integrally formed to the driving portion and is rotatable therewith. The driving portion is rotatable between an open and locked position. The locking apparatus has a detent member having a detent portion and a retaining portion. The detent portion is received in the chamber through the transverse opening to engage the driving member to provide a detent. The retaining portion extends along the housing to engage a retaining plate to secure the housing to the retaining plate.

According to another aspect of the invention, a locking apparatus is adapted for insertion into a retaining plate. The retaining plate is provided with an opening to receive the locking apparatus. The locking apparatus comprises an elongate housing having first and second open ends. The housing defines a longitudinal chamber between the first and second ends. The housing further defines a transverse opening between the first and second ends. The locking apparatus has a unitary driver, a portion of which is rotatably disposed in the chamber. The driver has a driving portion located in the chamber near the second end and a tenon portion extending from the second end. The tenon portion is integrally formed to the driving portion and rotatable therewith. The driving portion is rotatable between an open and a locked position. The locking apparatus has a retaining member coupled to the housing. The retaining member has a first end and a second end. The second end of the retaining member defines an abutment member for engaging the retaining plate to secure the housing to the retaining plate.

In another embodiment of this invention, a locking apparatus is provided with an elongate housing having a first end and second end. The first end, corresponding to the key end, is open and is adapted to receive a locking core. The second end is open and is adapted to house a unitary driver. The unitary driver comprises a driving portion that is rotatable within the housing, adjacent the second end. The unitary driver also comprises a tenon portion. The tenon is integrally combined with the driving portion. A retainer is provided to rotatably secure the unitary driver, near the second end of the housing. The retainer may comprise one or more channels positioned transversely relative to the housing. The channels contain one or more corresponding bearing elements.

The bearing elements are held within a corresponding channel opening radially positioned between an inner surface of the housing and an outer surface of the driving portion. The bearing elements engage with the radially positioned channel opening to secure the rotatable driving portion against removal from the second end of the housing. The bearing elements may be biased to engage with the peripherally positioned channel opening. The bearing elements may be radially positioned at regular intervals between the opposing interior surfaces of the housing and the driving portion.

In another aspect of this invention, a unitary driver is provided for use with other locking apparatus components, including locking core housings and locking cores.

DESCRIPTION

Locking apparatus 1 includes a unitary driver 4 and an elongate housing 10. The unitary driver 4 and the housing 10 are shown in a disassembled form in FIGS. 1 and 2.

Figure 1:
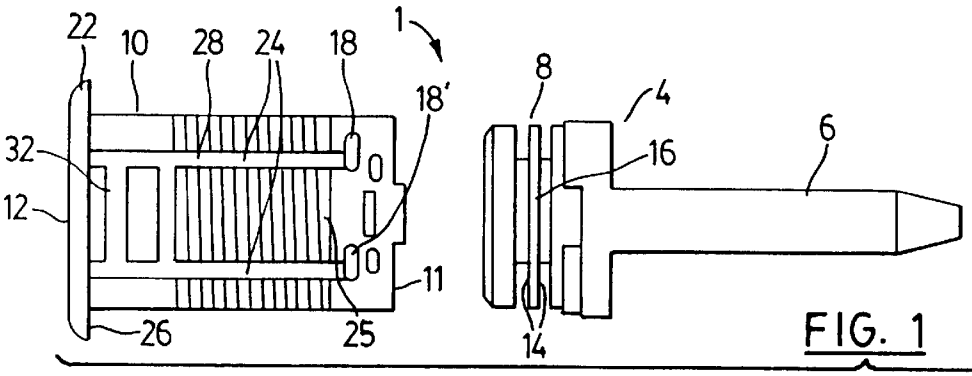
FIG. 1 is an exploded top view of a locking mechanism of a first embodiment of the present invention.
Figure 2:
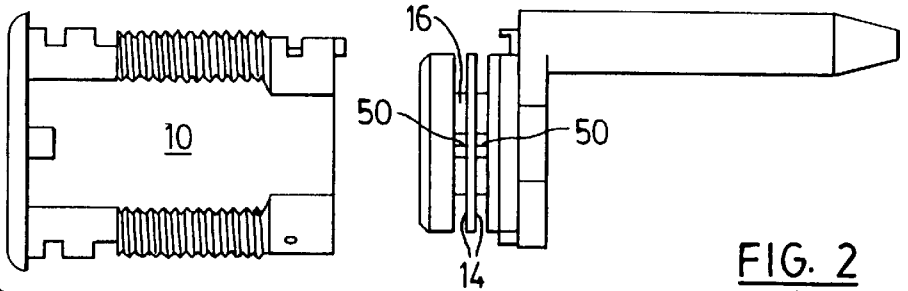
FIG. 2 is an exploded side view of the first embodiment.
Figure 3:
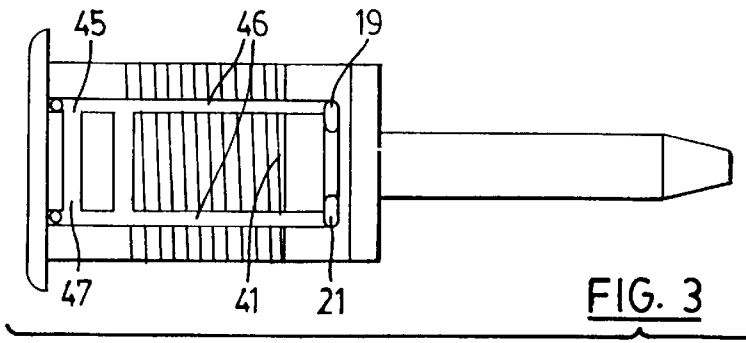
FIG. 3 is a bottom view of the first embodiment.

The housing 10 has front end (or driver end) 11 and a rear end (or key end) 12. A lip 22 is located on the rear 12 of the housing 10. The lip 22 has an inner shoulder 26. The housing 10 has a top surface 25 and a bottom surface 41, as shown in FIGS. 1 and 3 respectively. The housing defines a set of upper transverse openings 18, 18', formed through the top surface 25 of the housing 10 and a set of lower transverse openings 19, 21 formed through the bottom surface 41 of the housing 10. Lower transverse opening 21 is slightly enlarged relative to the lower transverse opening 19. The upper and lower transverse openings are offset to receive corresponding detent members or retainers. A generally U-shaped upper groove 28 is preferably formed on the top surface of the housing 10. The upper groove 28 has longitudinal sections 24 and a transverse section 32. Each of the longitudinal sections 24 end in a respective upper transverse opening 18. The bottom surface 41 is substantially identical to the top surface 25. Bottom surface 41 defines a generally U-shaped lower groove 45. Lower groove 45 has longitudinal sections 46 and a transverse section 47. Each of the longitudinal sections 46 end in a respective lower transverse opening 19, 21.

Figure 10:
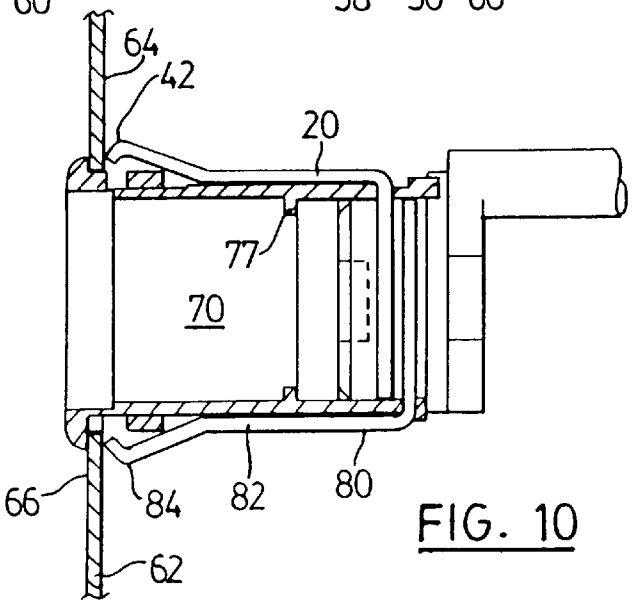
FIG. 10 is a sectional view of the first embodiment of the present invention showing the retaining portion in an engaged position.
Figure 9:
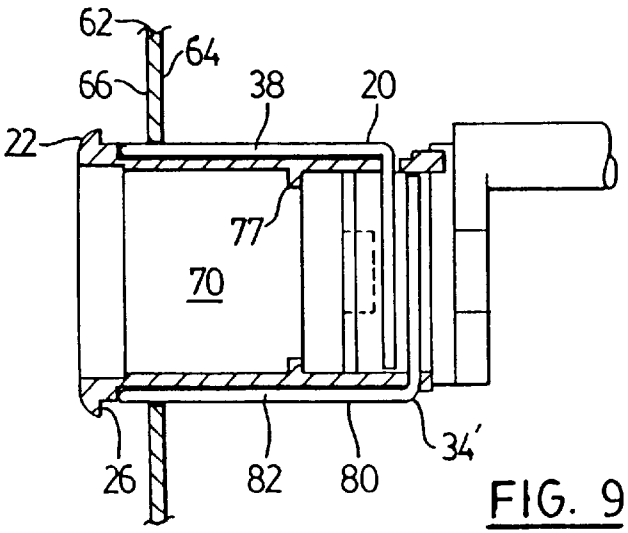
FIG. 9 is a sectional view of the first embodiment of the present invention showing a retaining portion of the detent member in a depressed position.

The housing 10 is hollow and defines a chamber 70, as shown in FIGS. 9 and 10. The front 11 and rear 12 ends of the housing 10 are open and are continuous (communicate) with the chamber 70.

The unitary driver 4 is machined as a single piece and includes a driving portion 8 that is integrally formed to a tenon 6. The unitary driver 4 is received in the chamber 70 of the housing 10 through the front end 11 of the housing, as shown in FIG. 3. The unitary driver 4 is rotatable in the chamber. The driving portion 8 is located rearwardly to the tenon 6 and defines circumferential grooves 14. The driving portion 8 defines recesses 50 located on a circumferential surface 16 located at the bottom of each of the grooves 14. Preferably, there are two recesses 50. However, it is possible to include a single or multiple recesses 50 in other embodiments. Similarly, a single, or multiple grooves 14 may be included in alternate embodiments. The tenon 6 projects frontwardly from the driving portion 8 and extends from the front 11 of housing 10 toward corresponding locking elements (not shown) located interior of a furniture piece or other locking structure.

Figure 8:
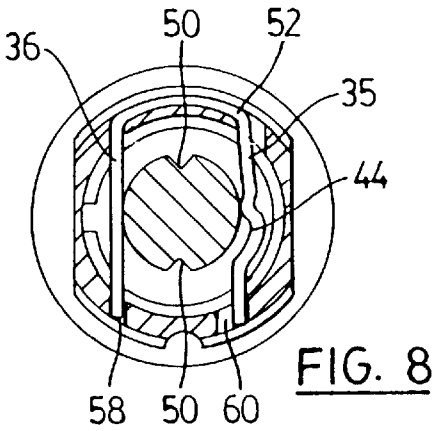
FIG. 8 is a cross section taken along the lines 8—8 of FIG. 5 showing the detent member in a disengaged position.
Figure 7:
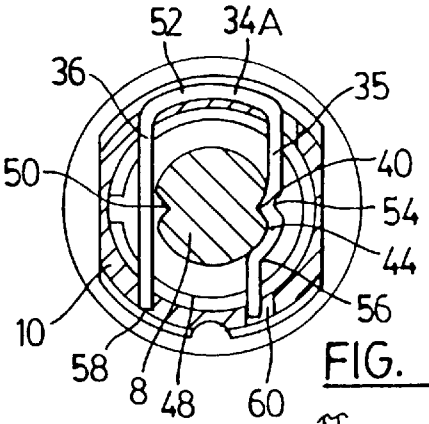
FIG. 7 is a cross section taken along the line 7—7 of FIG. 5 showing the detent member in an engaged position.
Figure 6:
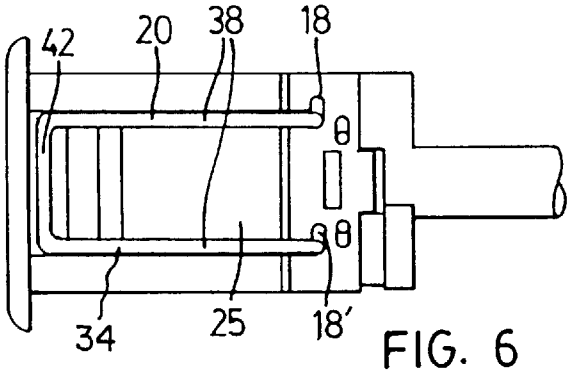
FIG. 6 is a top view of the first embodiment having the detent member installed.

With reference to FIGS. 1 and 6, a detent member 34 (shown in FIG. 6) is received through the openings 18, 18' (shown in FIG. 1). The detent member 34 is made of a resilient and flexible material. With reference to FIGS. 7 and 8, the detent member has a detent portion 52. Detent portion 52 has a first arm 35 and a straight second arm 36. The first arm 35 defines dog-legs 54, 56. The first arm 35 has a protrusion 40 and an indentation 44 located between the dog-legs 54, 56. The first arm 35 is received through opening 18 of the housing 10. The second arm 36 of the detent member 34 is received through opening 18' of the housing 10. First arm 35 and second arm 36 are received in one of the grooves 14 of the driver 4 when the driver 4 is installed in the housing 10. In an alternate embodiment (not shown) of the invention, both of the arms 35, 36 of the detent member 34 are straight.

In one embodiment, the detent member 34 has an upper retaining portion 20 and a lower retaining portion 80 as shown in FIG. 9. Upper retaining portion 20 has horizontal extensions 38 which are received in the longitudinal sections 24 of the groove 28. An upper abutment member 42 projects upwardly from the upper surface 25. The upper abutment member 42 is received in the transverse section 32 of the upper groove 28 when depressed. Similarly, lower retaining portion 80 has horizontal extensions 82 which are received in the longitudinal sections 46 of the lower groove 45. A lower abutment member 84 projects downwardly from the lower surface 41. The lower abutment member 84 is received in the transverse section 47 of the lower groove 45 when depressed.

Figure 11:
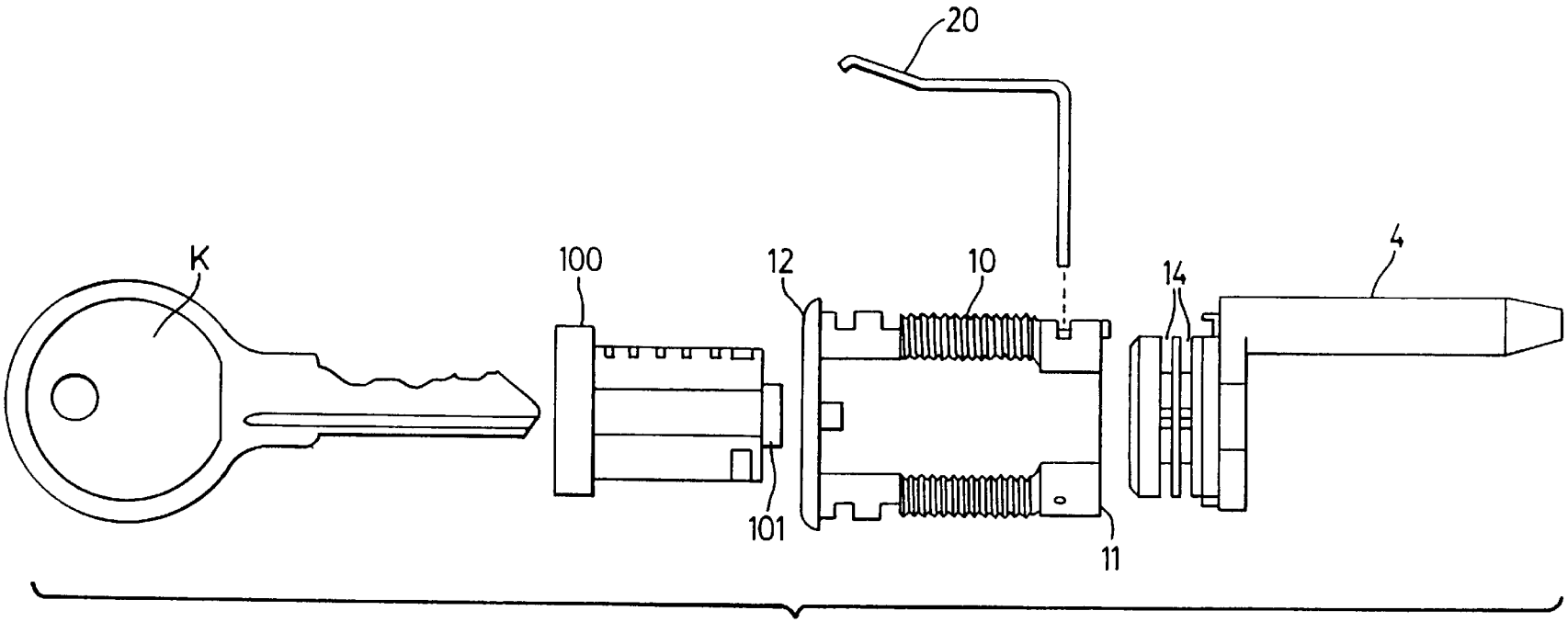
FIG. 11 is an exploded view of the first embodiment showing the locking mechanism together with a key and conventional locking core mechanism.

A key K and locking core 100 (as illustrated in FIG. 11) that is known in the art may be inserted into the key end 12 of the housing 30. The key mechanism can be coupled to the driver by standard methods know in the art. The key mechanism is coupled to the unitary driver 4 such that the unitary driver 4 may be rotated between locked and unlocked positions by turning the operating key.

As shown in FIG. 7, the protrusion 40 formed in arm 35 engages one of recesses 50. This engagement provides a detent whereby the driver 4 is preferentially positioned to signal a discrete operative position. The discrete positions permitted by the detent preferably correspond to the locked and unlocked positions. When the driving portion 8 is engaged in the locked or unlocked position by the detent, indentation 44 engages the driving portion 8 to provide a snug fit thereby providing additional stability. The number of detents corresponds to the number of recesses 50 that are formed in the driving portion 8.

As shown in FIG. 8, as the driver 4 is rotated, the protrusion 40 becomes disengaged from recess 50. The driving portion 8 also becomes disengaged from the indentation 44. Once the protrusion 40 is clear of the recess 50, driving portion 8 pushes arm 35 forward in the lower transverse opening 60. As the driver 4 is rotated, the protrusion 40 will eventually engage the next recess 50 to provide a second detent position corresponding to the position shown in FIG. 7.

It is not strictly necessary that a recess be formed on the driver 4 and a protrusion be formed on the detent member 34. Other embodiments are possible where the driver 4 and the detent member 34 are mutually engaged through other means that will be understood by those skilled in the art. In an alternate embodiment, protrusions are formed on the driving portion 8 in grooves 14 while complimentary indentations are defined by the first arm 35 of the detent member 34 for receiving the protrusions to provide a detent.

Preferably, a locking latch (not shown) is attached to the tenon 6. Tenon 6 acts as a cam in that rotation of the tenon 6 translates into linear movement of the locking latch between the locked and unlocked position. In the locked position, the locking latch engages a solid surface (not shown) to prevent a drawer (not shown) from opening. In the unlocked position the latch clears any solid surface to permit opening of the drawer. It will be understood to persons skilled in the art that the tenon may be configured in alternate ways. In another example, the tenon may be located on the central axis of the unitary driver. The tenon may have a recess, or protrusion adapted to engage with other components (not shown) to operate the latch.

In order to install the locking mechanism into a drawer, the housing is inserted into an opening in the furniture (or other structure) from front to back, as shown in FIG. 9. A retaining plate 62 is attached to the drawer. The retaining plate 62 is provided with an opening that overlaps the opening of the drawer. As shown in FIG. 9, the extensions 38 and 82 of the detent member 34 members 34, 34' are pressed into longitudinal groove sections 24 and 46 respectively as the housing 10' is pushed through the opening of the retaining plate 62. When the resilient abutment members 42 and 84 clear the opening, they spring outwardly to engage an inner surface 64 of the retaining plate 62, as shown in FIG. 10. At the same time, shoulder 26 abuts an outer surface 66 of the retaining plate 62. The retaining plate is firmly secured between the abutment members 42 and 84 and the shoulder 26 of the housing 10. The housing is thereby firmly secured to the retaining plate without the need for a fastening clip.

Figure 4:
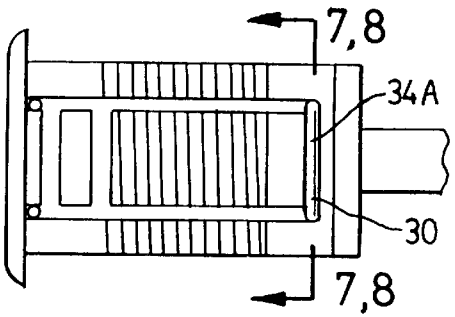
FIG. 4 is a top view of an alternate embodiment of the present invention having a detent member installed.
Figure 5:
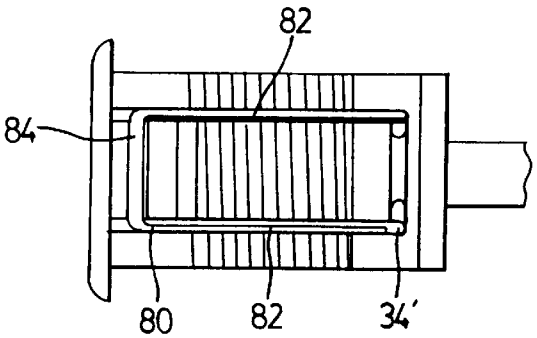
FIG. 5 is a bottom view of the first embodiment of the present invention having a detent member installed.

In an alternate embodiment shown in FIG. 4, the detent member 34A does not have retaining portions 20 and 80. The first arm 35 is joined to the second arm 36 by a connecting member 30. The detent member is generally U-shaped. Otherwise, this alternate embodiment is identical to the above described embodiment. The detent member 34 may be either removably received in the openings 18, 18' or permanently fastened in the openings 18, 18'. With such an arrangement it is possible to use a standard fastening clip known in the art to secure the housing 30 to the retaining plate 62.

In another embodiment, the housing 10 defines two sets of upper transverse openings 18, 18' and two sets of lower transverse openings 19, 21. The detent member of the first described embodiment is received in the first set of transverse openings and a first circumferential groove 14. The detent member of the alternate embodiment described immediately above is received in the second set of transverse openings and a second circumferential groove 14. This embodiment therefore includes two detent members having distinct configurations.

Figure 12:
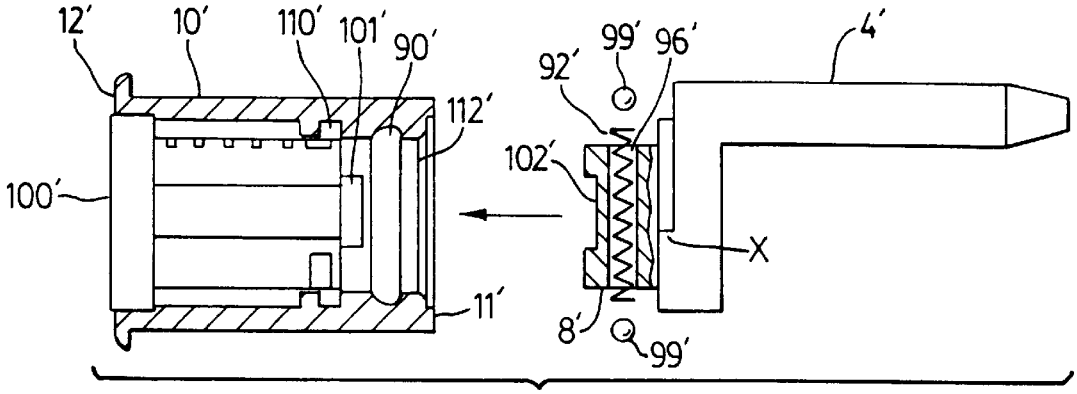
FIGS. 12, 13 and 14 show sequential front cross sectional views of a preferred embodiment, including an alternative retainer.
Figure 13:
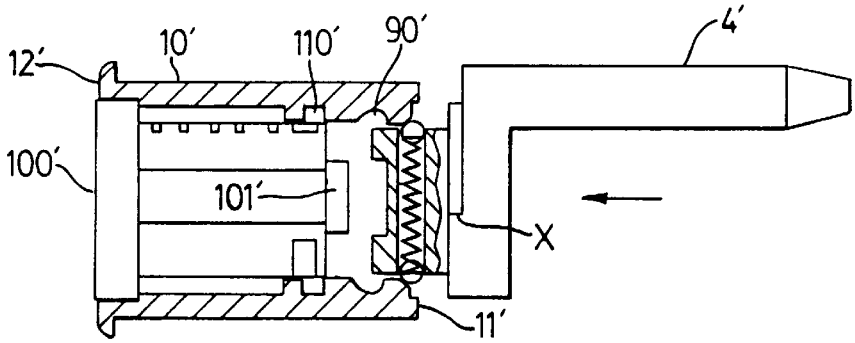
Figure 14:
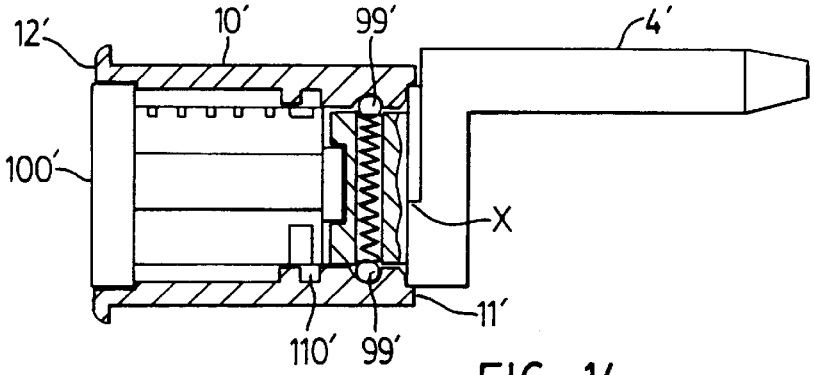

FIGS. 12, 13 and 14 show a preferred embodiment of the present invention. A locking core 100' is shown, inserted in key end 12' of housing 10' of the locking apparatus. The locking core 100', rotates within the housing, when actuated by an operating key (not shown). A locking core retainer (not shown) engages with channel 101' of the housing, to prevent removal of the core from the housing. A master key (not shown) may be used to disengage the locking core retainer from channel 101', and remove (or install) the core from (or into) the housing.

FIGS. 12, 13 and 14 show the sequential steps in assembling one embodiment of the unitary driver 4', by introducing the driver portion 8' into driver end 11' of the housing. Core driver 101' is configured to engage with corresponding recess 102' of the unitary driver. Rotation of the activated core will therefore result in rotation of the engaged, rotatable unitary driver. Driver end 8' defines an interior channel 96'. The channel 96' is positioned, in transverse relation to the longitudinal axis of the housing. Channel 96' contains a spring 92' which outwardly biases ball bearings 99', into engagement with open channel 90' defined by the housing. Chamfered rim edge 112' is provided to facilitate insertion of spring loaded bearings into the housing. The depth of open channel 90' is sufficiently greater than the radius of balls 99' to inhibit undesired retraction of the balls 99' into channel 96' which could result in accidental separation of the driver from the housing.

Unitary driver 4' is shown as having an abutment portion X configured to engage with a corresponding raised abutment on the housing, to limit rotation of the driver within a range of predetermined desired positions. For example, the driver and housing abutments may be configured to provide 90°, 180° or other rotational ranges as desired.

Figure 15:
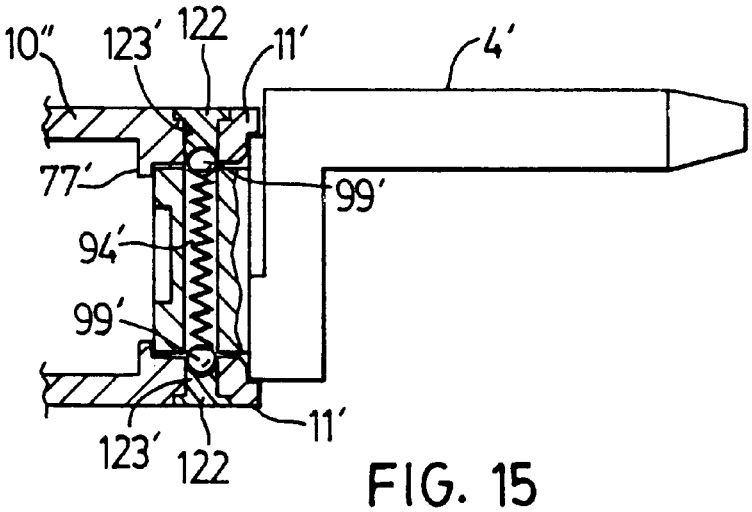
FIG. 15 shows a front cross sectional view of another embodiment, including a further alternative retainer.

In FIG. 15, yet another embodiment of the invention is shown. A cross-sectional view of the driver end 11' of the housing 10" is shown. Driver 4' is shown inserted in the driver end of the housing. The inner end of the rotatable unitary driver abuts against inner stop 77'.

Radially opposed plugs 122 are securely engaged in housing 10" The diameter of plugs 122 is larger than the diameter of bearing balls 99'. The locking mechanism is assembled by introducing the unitary driver 4' into the driver end 11' of the housing 10". Bearing balls are inserted into transverse channels 123', radially positioned about the housing. Retainer plugs 122 are inserted and secured within channels 123'. The retainer plugs maintain the ball bearings within the channel 94'. The bearing balls 99' travel within open channel 94' located about the periphery of the driver portion. It will be understood by persons skilled in the art that the bearing balls 99' when installed, will act to secure the rotatable unitary driver against removal from the driver end of the housing.

In another embodiment (not shown), modified retainer plugs (similar to plugs 122) are of greater length such that their respective terminal ends extend into the open channel 94'. The modified/extended plugs may be used in place of the combined plugs 122 and balls 99' shown in FIG. 15. The extended retainer plugs may be made of teflon or other materials suitable to form resilient bearing surfaces in contact with open channel 94'. In some embodiments, a single extended retainer plug may be sufficient.

From the foregoing description and from the drawings, it will be understood by those skilled in the art that the unitary driver and the housing may be reconfigured to permit embodiments in which the driver will be assembled by introduction into the housing through the key end opening. For example, in one embodiment (not shown) an abutment rim may be provided at the driver end of the housing. The tenon may be configured to have an effective diameter smaller than the diameter of the driving portion of the unitary driver. An outer edge of the driving portion will engage the abutment rim to prevent removal of the driver through the driver end opening of the housing. Radially positioned ball bearings and corresponding plugs may be installed to retain the driver in rotating attachment to the housing in a manner similar to that illustrated in FIG. 15.

Figure 16:
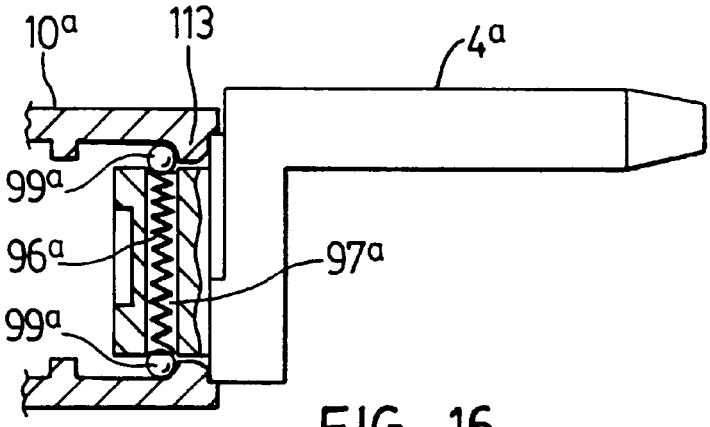
FIG. 16 shows a cross sectional view of another embodiment of the invention.

FIG. 16 is a cross sectional view showing yet another embodiment of the present invention. A modified housing $\mathbf{10}^a$ is provided with an integral raised inner retaining rim 113. The retaining rim 113 is located at the driver end of the housing $\mathbf{10}^a$. The unitary driver $\mathbf{4}^a$ is inserted into the driver end of the housing $\mathbf{10}^a$. Spring loaded balls $\mathbf{99}^a$ engage with retaining rim 113 to secure the driver $\mathbf{4}^a$ in rotatable engagement with the housing. Spring $\mathbf{96}^a$ biases bearing balls $\mathbf{99}^a$ outwardly from the driver portion of the unitary driver $\mathbf{4}^a$. Preferably, spring loaded balls $\mathbf{99}^a$ extend outwardly from interior channel $\mathbf{97}^a$ to an extent sufficient to inhibit accidental retraction of the balls if forces are applied to remove the unitary driver from the housing.

Figure 17:
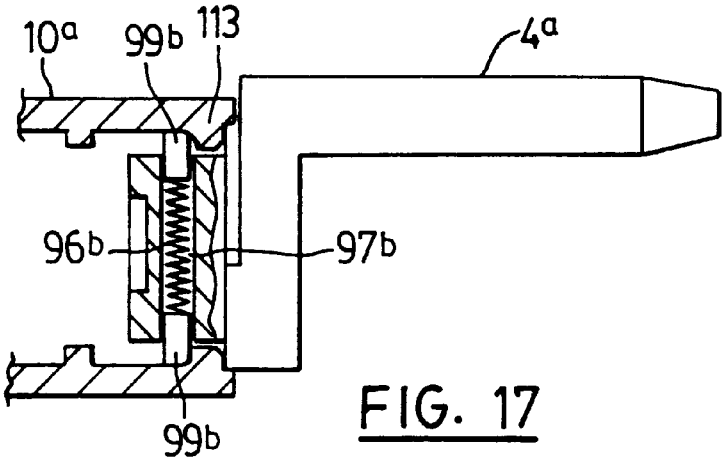
FIG. 17 shows a cross-sectional view of yet another embodiment of the invention.

FIG. 17 shows a cross sectional view of a further embodiment of the invention. A housing $\mathbf{10}^a$ is rotatably secured to unitary driver $\mathbf{4}^a$. Spring loaded retainer pins $\mathbf{99}^b$ are outwardly biased from the driver end of unitary driver $\mathbf{4}^a$. A spring $\mathbf{96}^b$ is loaded within inner channel $\mathbf{97}^b$ of the driver portion of unitary driver $\mathbf{4}^a$. Alternative embodiments (not shown) may provide a plurality of pins or other retainer members radially positioned about the driver end of the unitary driver. For example, each of the pins may be outwardly biased from within a corresponding inner channel, radially situated about the driver end of the unitary driver. The channels may be configured to contain corresponding spring members.

Although the invention has been described with certain embodiments including a preferred embodiment, it is to be understood that modifications may be resorted to as will be apparent to those skilled in the art. Such modifications and variations are to be considered within the purview and scope of the present invention.

What is claimed as the invention is:

1. A locking apparatus for use with a key operated rotatable locking core, the apparatus comprising:

an elongate housing comprising first and second open ends, said housing comprising an inner surface, the inner surface defining a longitudinal chamber between said ends, said apparatus further defining a transverse opening between said first and second open ends;

a rotatable unitary driver comprising a driving portion insertable into the chamber from the second open end of the housing and a tenon extending outwardly away from said second end of the housing and offset from an axis of rotation of the unitary driver, the driving portion being integrally formed to the tenon portion and rotatable therewith, the driver being rotatable between a locked position and an unlocked position, the driving portion being rotatably connected with the locking core when the locking core is inserted into the chamber from the first open end of the housing; and a retainer member received in said transverse opening to engage with said driving portion, thereby inhibiting withdrawal of the driving portion from the chamber.

2. A locking apparatus according to claim 1 wherein said driving portion defines a recess formed thereon, said retainer member defining a detent for engaging said recess.

3. A locking apparatus according to claim 1 wherein the driving portion defines a longitudinal axis and a circular outer wall extending about the longitudinal axis, and the transverse opening is defined by either the inner surface of the housing or the circular outer wall, the transverse opening being perpendicular to the axis.

4. A locking apparatus according to claim 1 wherein the transverse opening is an open inner channel positioned along the inner surface of the housing.

5. A locking apparatus according to claim 3 wherein the retainer member comprises a bearing traveling within an open outer channel defined by the other of the inner surface of the housing and the circular outer wall, the outer channel being in opposing alignment with the transverse opening.

6. A locking apparatus according to claim 5 wherein said bearing comprises a plurality of balls rotatably engaging the driver to the housing.

7. A locking apparatus according to claim 6 wherein the open outer channel is defined by the inner surface of the housing and is perpendicular to the longitudinal axis.

8. A locking apparatus as defined in claim 6, the circular outer wall defining a plurality of transverse openings, including the said transverse opening, each transverse opening receiving a corresponding one of the balls, the balls being in rotatable engagement with the open outer channel, the open channel being defined by the inner surface of the housing.

9. A locking apparatus according to claim 1 wherein the driving portion defines a groove for receiving the retainer member.

10. A locking apparatus according to claim 9 wherein the retainer comprises a flexibly resilient detent member.

11. A locking apparatus for installation into a movable member having an opening to receive the locking apparatus, and the movable member having an interior surface, the locking apparatus comprising:

an elongate housing adapted to be received in the opening formed in the movable member, the housing having a first open key end and a second open driver end, said housing defining a longitudinal chamber between the first and second ends, said housing further defining a transverse opening between the first and second ends; a unitary driver adapted for rotation within the chamber, the driver having a driving portion adapted for insertion in the chamber near the second end and a tenon portion extending from the second end, the tenon portion being integrally formed to the driving portion and being rotatable therewith, the driver being rotatable between an open and a locked position; and a retainer member having a detent portion and a stop portion, the detent portion being adapted for positioning along the transverse opening to rotatably engage the driver with the housing, the detent portion providing detents corresponding to said open and locked positions, the stop portion extending along said housing and comprising a first end attached to the detent portion and a second end located adjacent to the first end of the housing, the stop portion defining an abutment member to engage the interior surface of the movable member.

12. A locking apparatus according to claim 10 wherein the housing defines a shoulder for abutting the exterior surface of the movable member.

13. A locking apparatus according to claim 10 wherein the housing defines an exterior surface, and the stop portion includes a first and second generally parallel extensions extending along the exterior surface of the housing, the extensions being joined at one end to form said abutment member.

14. A locking apparatus according to claim 13 wherein said abutment member is formed of a resilient and flexible material, biased to project upwardly from the exterior surface of the housing.

15. A locking apparatus according to claim 14 wherein the exterior surface of the housing defines a generally U-shaped groove for receiving said first and second extensions and said abutment member.

16. A locking apparatus according to claim 15 wherein the stop portion includes a first set of extensions extending along an upper surface of the housing and a second set of extensions extending along a lower surface of the housing, each set of the extensions being joined adjacent the first end to form an abutment member.

17. A locking apparatus for housing a key operated rotating locking core in a movable member having an opening to receive the locking apparatus, the locking apparatus comprising:

an elongate housing receivable in the opening, the housing having a first open key end and a second open driver end, said housing defining a longitudinal chamber between the first and second open ends;

a unitary driving member comprising a driving portion inserted into the chamber through the second open end and a tenon portion extending longitudinally outwardly away from the second end and offset from an axis of rotation of the unitary driver, the tenon portion being integrally formed to the driving portion and rotatable therewith, the driving portion being rotatable between an open and a locked position, the driving portion rotatably associating with the locking core when the locking core is inserted into the chamber through the first open key end of the housing; and a retaining member interior of the housing, the retaining member having a first portion and a second portion, the first portion of the retaining member engaging the interior of the housing, the second portion of the retaining member rotatably securing the driving portion within said housing.

18. A locking apparatus according to claim 17 wherein the retaining member includes first and second extensions extending along said housing, the first and second extensions being joined at one end to form an abutment member.

19. A locking apparatus according to claim 18 wherein the abutment member is formed of a resilient and flexible material, biased to project away from said housing.

20. A locking apparatus according to claim 19 wherein the housing defines a generally U-shaped groove for receiving said retaining member.

21. A locking apparatus as defined in claim 17, wherein the retaining member comprises a plurality of bearing members.

22. A locking apparatus as defined in claim 21, the housing and the driving portion defining opposing surfaces, one of the opposing surfaces defining an open channel positioned transversely to the chamber.

23. A locking apparatus as defined in claim 22, wherein the bearing members comprise ball bearings.

24. A locking apparatus according to claim 23, wherein the ball bearings are biased to engage with the transversely positioned channel.

25. A unitary driver for use in connection with a locking apparatus, the locking apparatus comprising a retainer member having a first and second portion, a locking core housing defining a first open key end and a second open driver end, and further defining a longitudinal inner chamber between said first and second open ends, a transverse channel defined by the housing and opening into the chamber, the chamber being adapted to receive a locking core through the first open end and a portion of the unitary driver through the second open end, the first portion of the retainer being received within the channel and the second retainer portion extending into the chamber;

the unitary driver defining a longitudinal axis for rotation and comprising a cylindrical driver portion, the driver portion having a circular outer wall, and a tenon portion secured to the driver portion and extending away from the driver portion parallel to and offset from the longitudinal axis;

the driver portion is rotatable about the axis, within the inner chamber, upon insertion of the driver portion into the chamber through the second open end of the housing;

the driver portion defines a channel to receive the second portion of the retainer element for rotatable engagement of the driver portion with the housing; and the driver portion defines an engagement member for operatively connecting the driver portion to the locking core upon insertion of the driver portion into the chamber for rotation between a locked first position and a second unlocked position.

26. A unitary driver according to claim 25 wherein the channel defined by the driver portion extends from the circular outer wall inwardly toward and perpendicular to the longitudinal axis.

* * * * *